US005271170A

United States Patent [19]

Mieger

[11] Patent Number: 5,271,170

[45] Date of Patent: Dec. 21, 1993

[54] SCOOP FOR A MOBILE IMPLEMENT

[76] Inventor: Rolf Mieger, Fellheimer Weg 3, 7951 Kirchdorf 3, Fed. Rep. of Germany

[21] Appl. No.: 15,133

[22] Filed: Feb. 9, 1993

[30] Foreign Application Priority Data

Feb. 26, 1992 [DE] Fed. Rep. of Germany ... 9202499[U]

[51] Int. Cl.[5] ..... E02F 3/413

[52] U.S. Cl. ..... 37/406; 37/187; 37/379; 37/443

[58] Field of Search ..... 37/103, 117.5, 183 R, 37/187, 188, 186

[56] References Cited

U.S. PATENT DOCUMENTS 3,896,950 7/1975 McCain ..... 37/183 R X 3,920,137 11/1975 McCain ..... 37/187 X

FOREIGN PATENT DOCUMENTS 0459100 4/1991 European Pat. Off. .

*Primary Examiner*—Randolph A. Reese

*Assistant Examiner*—Arlen L. Olsen

*Attorney, Agent, or Firm*—Jacobson, Price, Holman & Stern

[57] ABSTRACT

A scoop for a mobile implement such as an excavator or an excavator-like device is made in two parts in the form of scoop sections able to be pivoted about parallel pivot axes by a piston and cylinder unit. The scoop includes an attachment head so that the scoop may be pivotally connected with a boom of the mobile implement. In order to pivot the entire scoop laterally, a further piston and cylinder unit is integrally provided for lateral pivoting of the entire scoop about a central pivot axis in the attachment head, the further piston and cylinder unit is connected at one end with a pivot point, preferably one of the pivot axes of one of the scoop sections, and at the other end with a lever. The lever is connected at one end with a pivot point, preferably the other respective one of the pivot axes on the other respective scoop section and the other end of the lever is connected via a link with a projection on the attachment head.

2 Claims, 1 Drawing Sheet

SCOOP FOR A MOBILE IMPLEMENT

FIELD OF THE INVENTION

The invention relates to a scoop for a mobile implement such as an excavator or an excavator-like device and which is made in two parts in the form of scoop sections able to be pivoted about parallel pivot axes by means of a piston and cylinder unit, and with an attachment head by means of which the scoop may be pivotally connected with the boom of such a mobile implement.

BACKGROUND OF THE INVENTION

A scoop for a mobile implement has already been disclosed in European patent publication 0 459 100 A1. In accordance with this prior design it is possible for a scoop, as for instance a digging scoop of a hydraulic excavator, to be operated in a grabbing manner owing to its two-part construction, without any compromises having to be made regarding an optimum configuration of the scoop. Therefore with this prior art scoop it is possible not only to handle bulk materials in a conventional manner but furthermore to grip large objects such as for instance boulders, beams, tubes, etc. Furthermore, the operation of the two-part scoop makes it possible to empty out sticky materials from it in an optimum manner.

On the other hand, single-part scoops have been proposed, which have a pivoting drive, with which they can be caused to perform a lateral pivoting movement through ± 45°.

SUMMARY OF THE INVENTION

One object of the present invention is to provide an improved scoop over the type initially mentioned that may be bodily pivoted laterally.

In accordance with the present invention this object is to be attained by in addition to a single piston and cylinder unit, the further development of a further integrated piston and cylinder unit provided for lateral pivoting of the entire scoop about a central pivot axis of the attachment head. The further piston and cylinder unit is on the one hand connected at the pivot axis on one of the shells of the scoop or scoop sections, and on the other hand with a lever, which is pivoted at one end thereof at the pivot axis on the respective other scoop section and at the other end is connected via a link with an extension of the attachment head.

The scoop or bucket in accordance with the invention has a small overall height despite the integrated pivoting drive and has a narrow width. It is an advantage, more particularly, that pivot axes can be systematically utilized as one already present in the case with the special-purpose scoop in accordance with the teaching of the European patent publication 0 459 100 A1. The force of the further piston and cylinder unit is arranged to act within two pivot points in the scoop in accordance with the invention with the result that the bearing reactions occurring may be optimally taken up. In the case of the use of a differential cylinder it is possible for the pivot moment on the left and on the right to be made equal.

The scoop can be pivotally carried on the attachment head using two triangular plates, the central pivot axis of the overall scoop being arranged at one corner of the two triangular plates, whereas the parallel pivot axes of the scoop sections are arranged at the two other respective corners of the two triangular plates.

Further advantageous developments and convenient forms of the invention will be understood from the following brief descriptive disclosure of embodiments thereof in conjunction with the accompanying drawings.

DETAILED DESCRIPTION OF THE PREFERRED EMBODIMENTS

Figure 2:
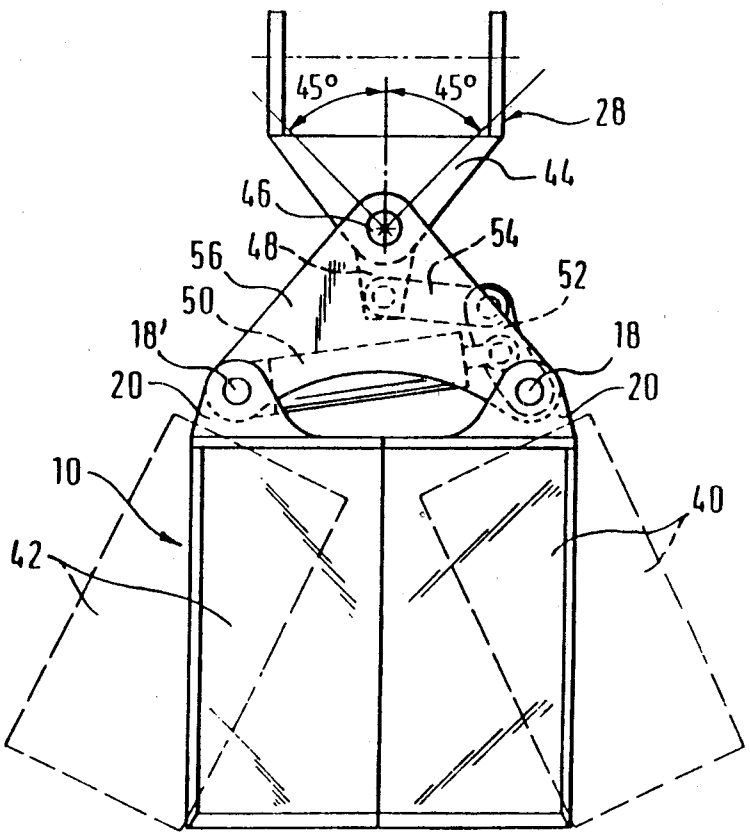
FIG. 2 is a front end view of the working embodiment in accordance with FIG. 1.
Figure 1:
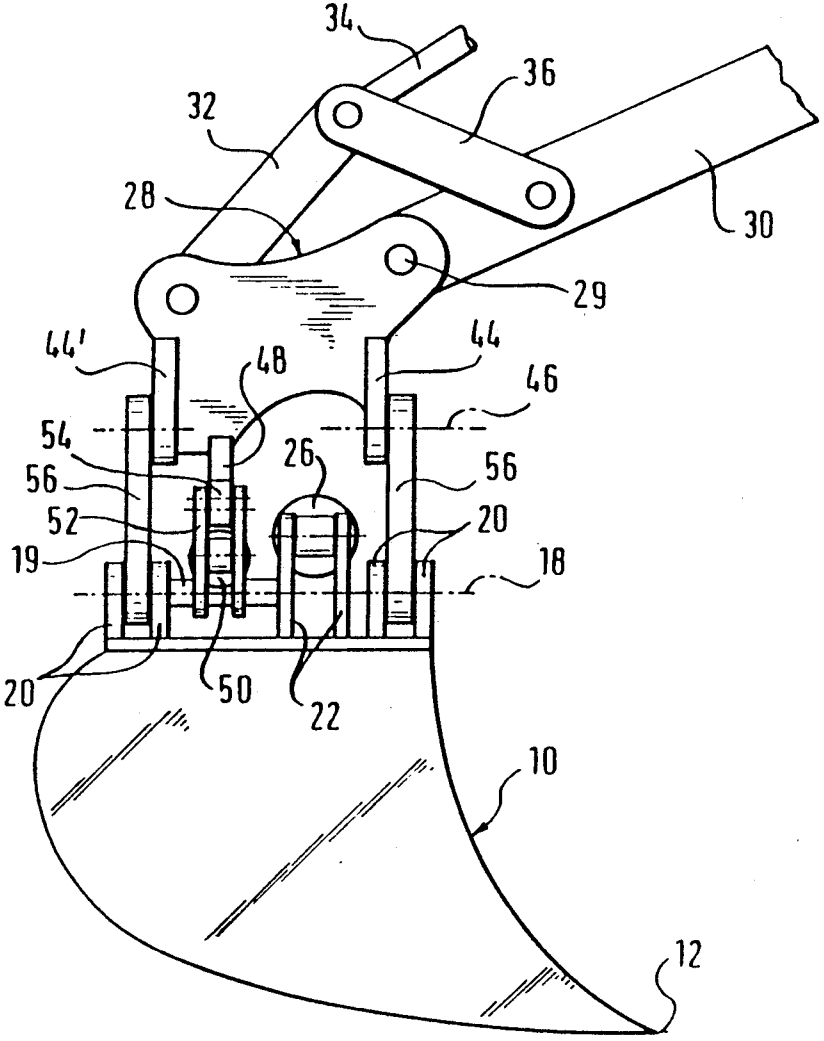
FIG. 1 is a lateral elevational view of one working embodiment of a scoop in accordance with the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The scoop 10 for a mobile implement such as an excavator possesses a conventional cutting edge 12 on which teeth are mounted, which are not illustrated. The scoop is suspended from an attachment head 28, which is pivotally attached to the boom 30 of the implement at pivot point 29. There are links 32 and 36 connected in a conventional manner with the boom 30 and to the attachment head, which links are able to be moved by a piston and cylinder unit 34, such parts rendering possible the conventional movement of a digging scoop about pivot point 29.

The scoop 10 is divided into scoop sections or shells 40 and 42 in a plane which is essentially perpendicular to the cutting edge 12 and parallel to the side walls of the scoop, as clearly shown in FIG. 2. The scoop sections or shells 40 and 42 have bearing lugs 20, by means of which they can be pivoted about pivot pins defining pivot axes 18 and 18' in a direction which is perpendicular to the normal direction of pivoting of the scoop 10 about pivot point 29. Additional pivot lugs 22 are also formed on the scoop sections 40 and 42, between which lugs 22 a piston and cylinder unit 26 so extends between the scoop sections 40 and 42 with one end of the piston and cylinder unit 26 mounted between lugs 22 on scoop section 40 and the other end of piston and cylinder unit 26 mounted between lugs 22 on scoop section 42. The piston and cylinder unit 26 is employed to move the scoop sections 40 and 42 laterally. In this manner, the scoop may be opened and closed as is indicated in FIG. 2 in broken lines.

On two plates 44 and 44' of the attachment head 28, two triangular plates 56 are pivoted for swinging about a central pivot axis 46. The pivot axis 46 extends through an upper respective corner of the triangular plates 56. At the two other corners of each of the triangular plates 56, the sections 40 and 42 of the scoop 10 are pivoted by means of bearing lugs 20. The pivot pin defining the axis 18' of the scoop section 42 is connected with one end of a further piston and cylinder unit 50. The other end of this piston and cylinder unit 50 is connected with a lever 52 intermediate the ends of the lever 52. One end of the lever 52 is pivotally connected with the pivot pin defining the pivot axis 18, constituted by the pin 19, on the scoop section 40. The other end of the lever 52 is connected via a link 54 with an extension 48 on the attachment head 28.

By means of the piston and cylinder unit 50 the entire scoop is pivoted about the central pivot axis 46 in relation to the attachment head 28. In this respect a pivot angle of approximately ± 45° is possible, as depicted in FIG. 2. On pivoting the scoop sections or halves 40 and 42 about the pivot axes 18 and 18', the distance between the axes and consequently the leverages remain constant.

Having described the invention, many modifications thereto will become apparent to those skilled in the art to which it pertains without deviation from the spirit of the invention as defined by the scope of the appended claims.

I claim:

1. A scoop for a mobile excavator implement, said scoop comprising:

an attachment head pivotally connected with a boom of a mobile excavator implement, two scoop sections pivotable about parallel pivot axes, first piston and cylinder unit means for pivoting said two scoop sections about said parallel pivot axes, second piston and cylinder unit means for lateral pivoting of said two scoop sections as a single unit about a central pivot axis in said attachment head, said second piston and cylinder unit means being connected at one end with a pivot point at one of said parallel pivot axes of one of said two scoop sections and at the other end of said second piston and cylinder unit means with a lever having one end connected with a pivot point at the other one of said parallel pivot axes on the other of said two scoop sections and the other end of said lever being connected via a link with a projection on said attachment head.

2. The scoop as claimed in claim 1, wherein said two scoop sections are connected pivotally by two triangular plates at said central pivot axis by one corner of said two triangular plates and said parallel pivot axes of said two scoop sections are arranged in the other two corners of said two triangular plates.

* * * * *